US011450460B2

(12) United States Patent
Takebayashi et al.

(10) Patent No.: US 11,450,460 B2
(45) Date of Patent: Sep. 20, 2022

(54) GRAIN-ORIENTED ELECTRICAL STEEL SHEET

(71) Applicant: NIPPON STEEL CORPORATION, Tokyo (JP)

(72) Inventors: Seiki Takebayashi, Tokyo (JP); Shuichi Nakamura, Tokyo (JP); Hiroyasu Fujii, Tokyo (JP); Yoshiyuki Ushigami, Tokyo (JP); Shinsuke Takatani, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 287 days.

(21) Appl. No.: 16/629,523

(22) PCT Filed: Jul. 13, 2018

(86) PCT No.: PCT/JP2018/026617

§ 371 (c)(1),
(2) Date: Jan. 8, 2020

(87) PCT Pub. No.: WO2019/013350

PCT Pub. Date: Jan. 17, 2019

(65) Prior Publication Data

US 2020/0126698 A1 Apr. 23, 2020

(30) Foreign Application Priority Data

Jul. 13, 2017 (JP) ..... JP2017-137443

(51) Int. Cl.
*H01F 1/147* (2006.01)
*C22C 38/60* (2006.01)

(52) U.S. Cl.
CPC ..... *H01F 1/14783* (2013.01); *C22C 38/60* (2013.01)

(58) Field of Classification Search
CPC ..... H01F 1/14783; H01F 1/18; C21D 8/1283; C22C 38/00; C22C 38/004; C22C 38/02;
(Continued)

(56) References Cited

U.S. PATENT DOCUMENTS 4,897,131 A 1/1990 Wada et al.

FOREIGN PATENT DOCUMENTS

CN 1461357 A * 12/2003 ..... C21D 8/1288
EP 2664689 A1 11/2013
(Continued)

OTHER PUBLICATIONS

Russian Office Action and Search Report for counterpart Russian Application No. 2020100034/02, dated Apr. 6, 2020, with English translation.

(Continued)

*Primary Examiner* — Jenny R Wu
(74) *Attorney, Agent, or Firm* — Birch, Stewart, Kolasch & Birch, LLP

(57) ABSTRACT

A grain-oriented electrical steel sheet includes: a base steel sheet; an intermediate layer arranged in contact with the base steel sheet; and an insulation coating arranged in contact with the intermediate layer to be an outermost surface, in which the intermediate layer has a local oxidized area when viewing a cross section whose cutting direction is parallel to a thickness direction, and a thickness of the intermediate layer in an area where the local oxidized area is included is 50 nm or more, and a thickness of the intermediate layer in an area where the local oxidized area is not included is less than 50 nm.

5 Claims, 2 Drawing Sheets

(58) Field of Classification Search
CPC ... C22C 38/60; C23C 18/1208; C23C 18/127; C23C 18/1295; C23C 28/042; C23C 8/02; C23C 8/14; C23C 8/80
See application file for complete search history.

(56) References Cited

FOREIGN PATENT DOCUMENTS

| | | | |
|---|---|---|---|
| JP | 49-96920 | A | 9/1974 |
| JP | 62-36803 | A | 2/1987 |
| JP | 62-86123 | A | 4/1987 |
| JP | 62-133021 | A | 6/1987 |
| JP | 3-130376 | A | 6/1991 |
| JP | 5-148532 | A | 6/1993 |
| JP | 6-184762 | A | 7/1994 |
| JP | 7-278833 | A | 10/1995 |
| JP | 8-191010 | A | 7/1996 |
| JP | 9-78252 | A | 3/1997 |
| JP | 11-209891 | A | 8/1999 |
| JP | 2002-322566 | A | 11/2002 |
| JP | 2002-348643 | A | 12/2002 |
| JP | 2002-363763 | A | 12/2002 |
| JP | 2003-171773 | A | 6/2003 |
| JP | 2003-313644 | A | 11/2003 |
| JP | 2004-315880 | A | 11/2004 |
| JP | 2004-342679 | A | 12/2004 |
| JP | 2009-235568 | A | 10/2009 |
| JP | 2015-168839 | A | 9/2015 |
| JP | WO2016/125504 | A1 | 8/2016 |
| RU | 2407818 | C2 | 12/2010 |
| RU | 2580778 | C2 | 4/2016 |
| SU | 1608243 | A1 | 11/1990 |

OTHER PUBLICATIONS

International Search Report for PCT/JP2018/026617 (PCT/ISA/210) dated Sep. 18, 2018.
Written Opinion of the International Searching Authority for PCT/JP2018/026617 (PCT/ISA/237) dated Sep. 18, 2018.

* cited by examiner

GRAIN-ORIENTED ELECTRICAL STEEL SHEET

TECHNICAL FIELD OF THE INVENTION

The present invention relates to a grain-oriented electrical steel sheet excellent in coating adhesion. In particular, the present invention relates to a grain-oriented electrical steel sheet excellent in the coating adhesion of insulation coating even without a forsterite film.

Priority is claimed on Japanese Patent Application No. 2017-137443, filed Jul. 13, 2017, and the content of which is incorporated herein by reference.

RELATED ART

A grain-oriented electrical steel sheet is a soft magnetic material, is mainly used as a core material of a transformer, and is thus required to have magnetic characteristics such as high magnetization characteristics and low iron loss. The magnetization characteristics relate to the magnetic flux density induced when a core is excited. As the magnetic flux density increases, the core can be reduced in size, which is advantageous for the device configuration of the transformer, and also advantageous for the cost of manufacturing the transformer.

In order to increase the magnetization characteristics, it is necessary to control the texture to the crystal orientation (Goss orientation) in which the {110} plane is aligned parallel to the steel sheet surface and the <100> axis is aligned with the rolling direction. In order to align the crystal orientation with the Goss orientation, in general, the inhibitors such as AlN, MnS, and MnSe are finely precipitated in steel, and thereby, the secondary recrystallization is controlled.

The iron loss is a power loss consumed as heat energy when the core is excited by an alternating-current magnetic field. The iron loss is required to be as low as possible from the viewpoint of energy saving. The level of iron loss is influenced by magnetic susceptibility, sheet thickness, coating tension, the amount of impurities, electrical resistivity, grain size, magnetic domain size, and the like. Even at the present time with various technologies developed for electrical steel sheets, research and development for reducing iron losses are continuously performed to improve energy efficiency.

Another characteristic required for the grain-oriented electrical steel sheet is a characteristic of a film and a coating formed on the surface of the base steel sheet. In general, in a grain-oriented electrical steel sheet, as shown in FIG. 1, a forsterite film 2 mainly containing $Mg_2SiO_4$ (forsterite) is formed on the base steel sheet 1, and an insulation coating 3 is formed on the forsterite film 2. The forsterite film and the insulation coating electrically insulate the surface of the base steel sheet, and have a function of applying tension to the base steel sheet to reduce the iron loss. The forsterite film contains, in addition to $Mg_2SiO_4$, a small amount of impurities and additives derived from the base steel sheet, an annealing separator, and reaction products thereof.

In order for the insulation coating to exhibit insulation properties and required tension, the insulation coating must not delaminate from the electrical steel sheet, and therefore, the insulation coating is required to have high coating adhesion. However, it is not easy to simultaneously increase both the tension applied to the base steel sheet and the coating adhesion. Even at the present time, research and development to simultaneously increase both properties are continuously carried out.

The grain-oriented electrical steel sheet is typically manufactured by the following procedure. A silicon steel slab containing 2.0 to 4.0 mass % of Si is hot-rolled, subjected to annealing as necessary after the hot rolling, then subjected to cold-rolling once or cold-rolling two times or more times with intermediate annealing therebetween, and finished to a steel sheet having a final thickness. Thereafter, the steel sheet having the final thickness is decarburized in a wet hydrogen atmosphere, whereby the primary recrystallization is proceeded in addition to decarburization and an oxide layer is formed on the surface of the steel sheet by oxidizing and precipitating $SiO_2$ (silica).

An annealing separator containing MgO (magnesia) as a main component is applied to the steel sheet having the oxide layer. After drying the annealing separator, the steel sheet is wound into a coil. Subsequently, the coiled steel sheet is final-annealed, whereby the secondary recrystallization is promoted and the grains are aligned with the Goss orientation. In addition, the MgO in the annealing separator is reacted with the $SiO_2$ in the oxide layer, whereby an inorganic forsterite film mainly containing $Mg_2SiO_4$ is formed on the surface of the base steel sheet.

The steel sheet having the forsterite film is purifying-annealed, whereby the impurities in the base steel sheet are diffused to the outside and removed. Subsequently, after the steel sheet is flattening-annealed, a solution mainly containing a phosphate and colloidal silica is applied onto the surface of the steel sheet having the forsterite film, and then, the steel sheet is baked, whereby an insulation coating is formed. At the time, tension is imparted between the base steel sheet which is crystalline and the insulation coating which is substantially amorphous due to the difference in thermal expansion coefficient therebetween.

The interface between the forsterite film ("2" in FIG. 1) mainly containing $Mg_2SiO_4$ and the steel sheet ("1" in FIG. 1) typically has an uneven shape which is not uniform (see FIG. 1). The uneven shape of the interface slightly deteriorates the iron loss reduction effect due to tension. Since the iron loss is reduced when the interface is smoothed, the following developments have been carried out up to the present.

Patent Document 1 discloses a manufacturing method in which a forsterite film is removed by pickling or the like, and the surface of a steel sheet is smoothened by chemical polishing or electrolytic polishing. However, in the manufacturing method of Patent Document 1, there are cases where an insulation coating is difficult to adhere to the surface of a base steel sheet.

Therefore, in order to increase the coating adhesion of the insulation coating to the steel sheet with smooth surface, as shown in FIG. 2, forming an intermediate layer 4 (or base coating) between the base steel sheet and the insulation coating is suggested. Patent Document 2 discloses a method of annealing a steel sheet in a specific weakly oxidizing atmosphere before forming an insulation coating to form an externally oxidized $SiO_2$ layer as an intermediate layer on the surface of the steel sheet.

Furthermore, Patent Document 3 discloses a method of forming 100 mg/m$^2$ or less of an externally oxidized $SiO_2$ layer as an intermediate layer on the surface of a base steel sheet before forming an insulation coating. Patent Document 4 discloses a method of forming an externally oxidized amorphous layer such as $SiO_2$ as an intermediate layer in a case where an insulation coating is a crystalline insulation coating mainly containing a boric acid compound and alumina sol.

Such an externally oxidized $SiO_2$ layer is formed on the surface of the base steel sheet in several tens of seconds to several minutes by a heat treatment with temperature and atmosphere appropriately controlled, functions as a base material (intermediate layer) of a smooth interface, and exhibits a certain effect in improving the coating adhesion of the insulation coating. However, further development is under way to more reliably secure the adhesion of the insulation coating formed on the externally oxidized $SiO_2$ layer.

Patent Document 5 discloses a method of performing a heat treatment on a base steel sheet having a smooth surface in an oxidizing atmosphere to form a crystalline intermediate layer of $Fe_2SiO_4$ (fayalite) or $(Fe,Mn)_2SiO_4$ (knebelite) on the surface of the steel sheet, and thereafter forming an insulation coating thereon.

However, in the oxidizing atmosphere in which $Fe_2SiO_4$ or $(Fe,Mn)_2SiO_4$ is formed on the surface of the base steel sheet, Si in the surface layer of the base steel sheet is oxidized and an oxide such as $SiO_2$ is precipitated, so that there are cases where iron loss characteristics deteriorate.

$Fe_2SiO_4$ and $(Fe,Mn)_2SiO_4$ in the intermediate layer are crystalline, while the insulation coating formed of a coating solution mainly containing a phosphate and colloidal silica is mostly amorphous. There are cases where the adhesion between the intermediate layer which is crystalline and the insulation coating which is substantially amorphous is not stable.

Patent Document 6 discloses a method of forming a gel coating having a thickness of 0.1 to 0.5 μm as an intermediate layer on the smooth surface of a base steel sheet by a sol-gel method, and forming an insulation coating on the intermediate layer. However, the coating conditions disclosed in Patent Document 6 are within the range of a typical sol-gel method, and there are cases where coating adhesion cannot be firmly secured.

Patent Document 7 discloses a method of forming a siliceous coating as an intermediate layer on the smooth surface of a base steel sheet by an anodic electrolytic treatment in an aqueous solution of silicate and thereafter forming an insulation coating.

Patent Document 8 discloses an electrical steel sheet in which an oxide such as $TiO_2$ (an oxide of one or more selected from Al, Si, Ti, Cr, and Y) is included in the form of layers or islands on the smooth surface of a base steel sheet, a silica layer is included thereon, and an insulation coating is further included thereon.

By forming such an intermediate layer, it is possible to improve the coating adhesion. However, since large facilities such as an electrolytic treatment facility or a dry coating facility are newly required, there are cases where it is difficult to secure the installation site, and the manufacturing costs increase.

Patent Document 9 discloses a grain-oriented silicon steel sheet in which an externally oxidized granular oxide mainly containing silica is provided in addition to an externally oxidized layer mainly containing silica with a thickness of 2 to 500 nm at the interface between a tension-applying insulation coating and a base steel sheet. Patent Document 10 also discloses a grain-oriented silicon steel sheet in which an externally oxidized layer mainly containing silica has voids in a cross-sectional area fraction of 30% or less.

Patent Document 11 discloses a method of forming, on the smooth surface of a base steel sheet, an externally oxidized layer as an intermediate layer, which has a thickness of 2 to 500 nm, contains metal iron in a cross-sectional area fraction of 30% or less, and mainly contains silica, and fouling an insulation coating on the intermediate layer.

Patent Document 12 discloses a method of forming, on the smooth surface of a base steel sheet, an intermediate layer which has a thickness of 0.005 to 1 μm, contains metal iron or an iron-containing oxide in a volume fraction of 1% to 70%, and mainly contains a silicon oxide, and forming an insulation coating on the intermediate layer.

Patent Document 13 discloses a method of forming, on the smooth surface of a base steel sheet, an externally oxidized layer as an intermediate layer, which has a thickness of 2 to 500 nm, contains a metal oxide (Si—Mn—Cr oxide, Si—Mn—Cr—Al—Ti oxide, or Fe oxide) in a cross-sectional area fraction of 50% or less, and mainly contains silica as an intermediate layer and forming an insulation coating on the intermediate layer.

As described above, when the intermediate layer mainly containing silica contains the externally oxidized granular oxide, voids, metal iron, iron-containing oxides, or metal oxides described above, the coating adhesion of the insulation coating is improved to some extent. However, in a case where the thickness of the intermediate layer mainly containing silica is thin, it becomes difficult to control the structure of the externally oxidized granular oxide, voids, metal iron, iron-containing oxide, or metal oxide included therein. Therefore, even in a case where the thickness of the intermediate layer mainly containing silica is thin, a further improvement in the coating adhesion is expected.

Patent Document 14 discloses a grain-oriented electrical steel sheet, in which a coating layer mainly containing $SiO_2$ formed by application and baking is included via an oxide layer mainly containing $SiO_2$ formed by an interfacial oxidation reaction, and a tension-applying insulation coating is included thereon, on the grain-oriented electrical steel sheet having no final-annealed coating.

According to the above-mentioned technology, it is possible to obtain a grain-oriented electrical steel sheet which is excellent in insulation coating adhesion and has a very low iron loss. However, in the above-mentioned technology, since the coating layer mainly containing $SiO_2$ is relatively thick, the diffusion of an oxygen source in the coating layer cannot be expected sufficiently. Therefore, in order to control the interfacial oxidation reaction, a process of forming an oxidation source in advance on the surface of the steel sheet or an annealing process is necessary, and there is a problem in terms of productivity.

Furthermore, in order to form the coating layer mainly containing $SiO_2$, it is necessary to newly add a process of applying a coating liquid such as colloidal silica, and there are still problems with facilities.

PRIOR ART DOCUMENT

Patent Document

[Patent Document 1] Japanese Unexamined Patent Application, First Publication No. S49-096920

[Patent Document 2] Japanese Unexamined Patent Application, First Publication No. H06-184762

[Patent Document 3] Japanese Unexamined Patent Application, First Publication No. H09-078252

[Patent Document 4] Japanese Unexamined Patent Application, First Publication No. 1107-278833

[Patent Document 5] Japanese Unexamined Patent Application, First Publication No. H08-191010

[Patent Document 6] Japanese Unexamined Patent Application, First Publication No. H03-130376

[Patent Document 7] Japanese Unexamined Patent Application, First Publication No. H11-209891

[Patent Document 8] Japanese Unexamined Patent Application, First Publication No. 2004-315880

[Patent Document 9] Japanese Unexamined Patent Application, First Publication No. 2002-322566

[Patent Document 10] Japanese Unexamined Patent Application, First Publication No. 2002-363763

[Patent Document 11] Japanese Unexamined Patent Application, First Publication No. 2003-313644

[Patent Document 12] Japanese Unexamined Patent Application, First Publication No. 2003-171773

[Patent Document 13] Japanese Unexamined Patent Application, First Publication No. 2002-348643

[Patent Document 14] Japanese Unexamined Patent Application, First Publication No. 2004-342679

DISCLOSURE OF THE INVENTION

Problems to be Solved by the Invention

Typically, the layering structure of a grain-oriented electrical steel sheet having no forsterite film basically has a three-layer structure of "base steel sheet-intermediate layer-insulation coating", and the structure between the base steel sheet and the insulation coating is macroscopically uniform and smooth (see FIG. 2). After a heat treatment, surface tension acts between the layers due to the difference in thermal expansion coefficient between the layers, so that tension can be applied to the base steel sheet, while the layers become to be easily separated.

In the layering structure of the above-mentioned three-layer structure, it is presumed that in a case where the thickness of the intermediate layer (the intermediate layer containing silicon oxide as a main component) mainly containing silicon oxide (silica, $SiO_2$) is relatively thin, portions thinner than the allowable lower limit of the thickness are locally included due to variation in the thickness of the intermediate layer although the portions are rare, and at these portions, the coating adhesion is reduced and the insulation coating easily delaminates. Such a local reduction in coating adhesion affects the tension applied to the base steel sheet, and therefore also affects the iron loss characteristics.

In order to respond to social demands such as energy saving policies in Japan and other countries in recent years, it is expected not only to provide a grain-oriented electrical steel sheet with high performance but also to enhance the productivity. In order to meet such expectations, it is necessary to shorten the time for an intermediate layer forming process, which is unique to the manufacturing of a grain-oriented electrical steel sheet having no forsterite film.

Therefore, the thickness of the intermediate layer must be minimized within a range in which the coating adhesion can be secured. In addition, since an annealing treatment for forming the intermediate layer is a factor of cost increase, the annealing temperature has to be set as low as possible from an economic viewpoint, and the thickness of the formed intermediate layer must be minimized.

Therefore, an object of the present invention is to form an insulation coating on the entire surface of an intermediate layer mainly containing silicon oxide so as not to cause uneven coating adhesion, and to increase the coating adhesion even in a case where the intermediate layer is thin and uneven. That is, an object of the present invention is to provide a grain-oriented electrical steel sheet excellent in the coating adhesion of insulation coating even when there is no forsterite film and the intermediate layer is thin and uneven.

Means for Solving the Problem

In the related art, in order to improve the coating adhesion of insulation coating and iron loss characteristics, an intermediate layer mainly containing silicon oxide is formed on the surface of a base steel sheet finished smooth more uniformly and smoothly. However, in practice, as described above, the coating adhesion of the insulation coating formed by applying and baking a coating solution mainly containing a phosphate and colloidal silica is uneven, and the insulation coating locally delaminates. Such instability of the coating adhesion becomes remarkable in a case where the thickness of the intermediate layer is thin.

The present inventors intensively studied methods for solving the above problems.

In the related art, an externally oxidized intermediate layer mainly containing silicon oxide is formed by performing annealing (thermal oxidation annealing, intermediate layer forming annealing) on a base steel sheet in an atmosphere with controlled dew point, and thereafter an insulation coating forming solution is applied to the surface of the intermediate layer and baked to form an insulation coating. The present inventors consider that the structure of the intermediate layer may change during the baking annealing of the coating solution, and investigated the change in the structure of the intermediate layer by changing the baking annealing conditions when the insulation coating forming solution is applied and baked.

As a result, the following findings were obtained.

(1) The interface with the base steel sheet is oxidized by the heat treatment during baking of the insulation coating forming solution, in the surface of the intermediate layer mainly containing silicon oxide, local oxidized areas (described later) mainly containing silicon oxide with a structure different from that of the intermediate layer are formed discretely.

(2) Excessive formation of the local oxidized areas lowers the coating adhesion of the insulation coating.

(3) By controlling the formation conditions of the externally oxidized intermediate layer mainly containing silicon oxide and the formation conditions of the insulation coating, and thereby, by controlling the formation state of the local oxidized areas, the coating adhesion of the insulation coating can be increased.

An aspect of the present invention adopts the following.

(1) A grain-oriented electrical steel sheet according to an aspect of the present invention includes: a base steel sheet; an intermediate layer arranged in contact with the base steel sheet; and an insulation coating arranged in contact with the intermediate layer to be an outermost surface, in which the intermediate layer has a local oxidized area when viewing a cross section whose cutting direction is parallel to a thickness direction, and a thickness of the intermediate layer in an area where the local oxidized area is included is 50 nm or more, and a thickness of the intermediate layer in an area where the local oxidized area is not included is less than 50 nm.

(2) In the grain-oriented electrical steel sheet according to (1), when viewing the cross section, and when a total length of an observed visual field in a direction orthogonal to the thickness direction is referred as Lz in units of μm, a total length of the local oxidized area in the direction orthogonal to the thickness direction is referred as Lx in units of μm, and a line fraction X of the local oxidized area is defined by a following Formula 1, the line fraction X may be 0.1% or more and 12% or less, $$X=(Lx\div Lz)\times 100 \quad \text{(Formula 1).}$$

(3) In the grain-oriented electrical steel sheet according to (1) or (2), the thickness of the intermediate layer in the area where the local oxidized area is included may be 50 nm or more and 400 nm or less, and the thickness of the intermediate layer in the area where the local oxidized area is not included may be 2 nm or more and less than 50 nm.

Effects of the Invention

According to the above aspect of the present invention, it is possible to provide a grain-oriented electrical steel sheet with an insulation coating having no unevenness in coating adhesion, that is, a grain-oriented electrical steel sheet excellent in the coating adhesion of insulation coating even when there is no forsterite film and the intermediate layer is thin and uneven.

EMBODIMENTS OF THE INVENTION

Hereinafter, a preferable embodiment of the present invention will be described in detail. However, the present invention is not limited only to the configuration which is disclosed in the embodiment, and various modifications are possible without departing from the aspect of the present invention. In addition, the limitation range as described below includes a lower limit and an upper limit thereof. However, the value expressed by "more than" or "less than" is not include in the limitation range.

A grain-oriented electrical steel sheet excellent in coating adhesion according to the present embodiment (hereinafter, sometimes referred to as the "electrical steel sheet of the present invention") is a grain-oriented electrical steel sheet in which there is no forsterite film on the surface of a base steel sheet, an intermediate layer mainly containing silicon oxide is arranged on the surface of the base steel sheet, an insulation coating formed by baking a coating solution mainly containing a phosphate and colloidal silica is arranged on the intermediate layer, and at the interface between the intermediate layer and the base steel sheet, local oxidized areas mainly containing silicon oxide formed by local oxidation of the surface of the base steel sheet during the baking annealing of the coating solution are discretely included.

Specifically, the grain-oriented electrical steel sheet according to the present embodiment is a grain-oriented electrical steel sheet including a base steel sheet, an insulation coating arranged on the outermost surface, and an intermediate layer arranged between the base steel sheet and the insulation coating, in which the intermediate layer has local oxidized areas when viewing a cross section (specifically, a cross section parallel to the thickness direction and perpendicular to the rolling direction) whose cutting direction is parallel to the thickness direction, the thickness of the intermediate layer in an area where the local oxidized areas are included is 50 nm or more, and the thickness of the intermediate layer in an area where the local oxidized area is not included is less than 50 nm.

Here, the grain-oriented electrical steel sheet having no forsterite film is a grain-oriented electrical steel sheet manufactured by removing a formed forsterite film, or a grain-oriented electrical steel sheet manufactured by suppressing the formation of a forsterite film.

Hereinafter, the electrical steel sheet of the present invention will be described.

Figure 1:
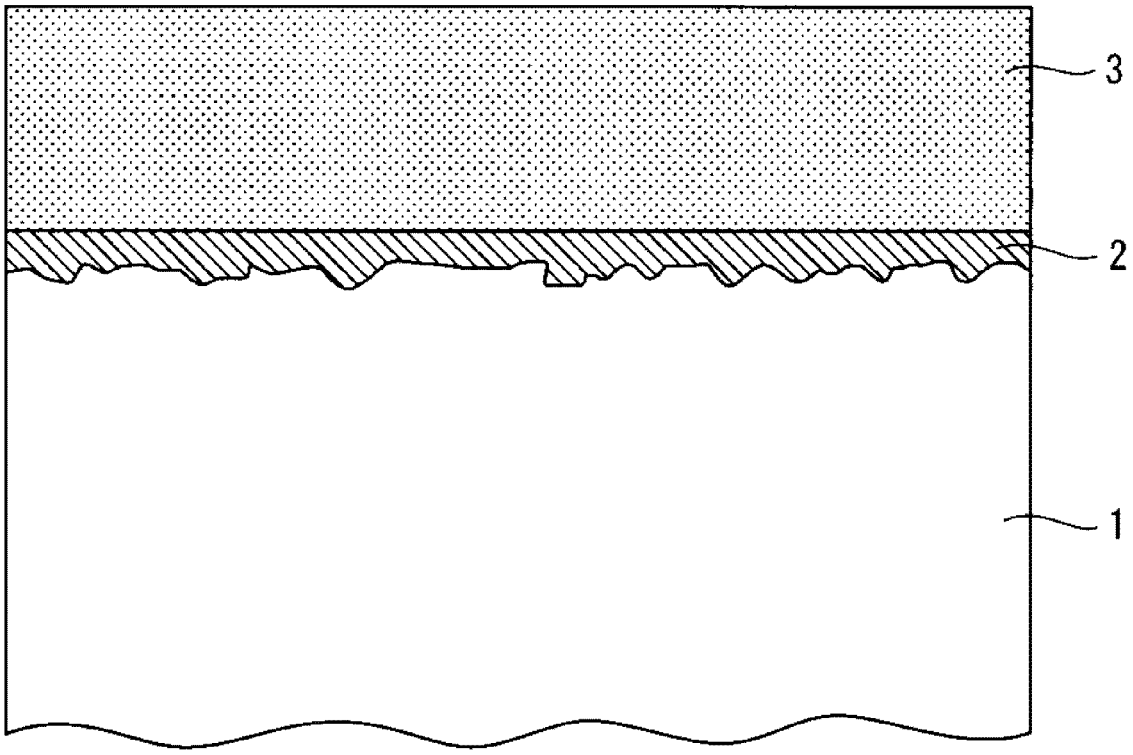
FIG. 1 PRIOR ART
FIG. 1 is a cross-sectional schema showing a layering structure of a grain-oriented electrical steel sheet in the related art.
Figure 2:
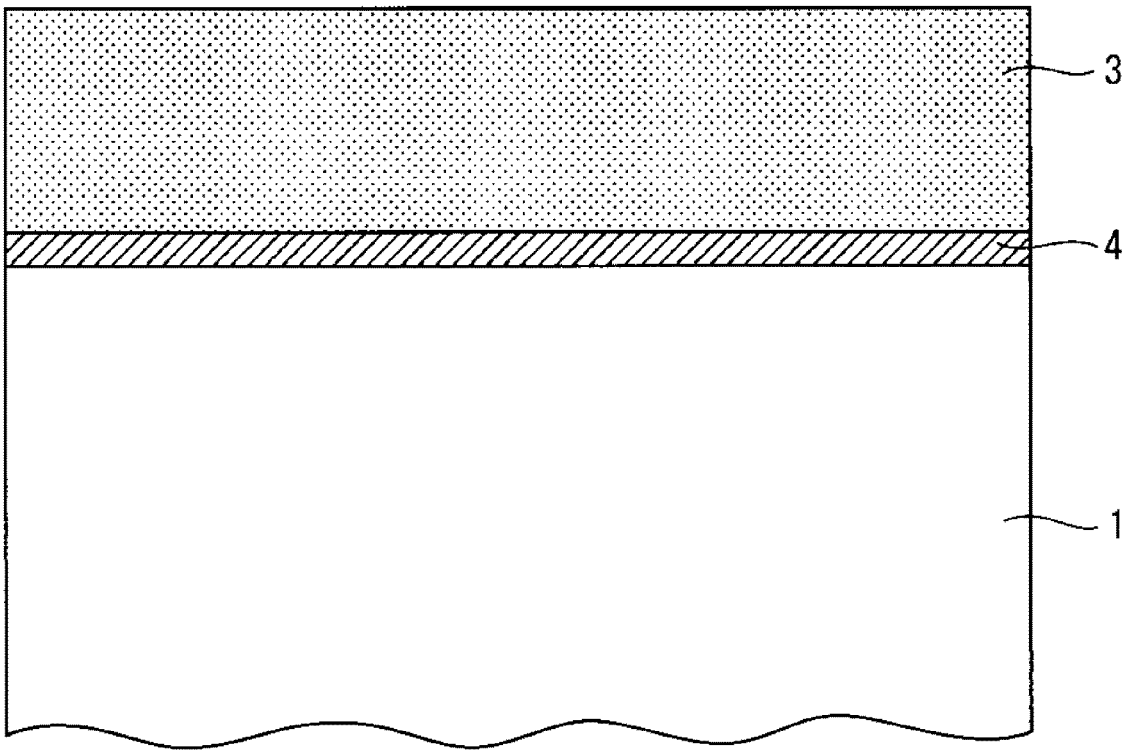
FIG. 2 PRIOR ART
FIG. 2 is a cross-sectional schema showing another layering structure of a grain-oriented electrical steel sheet in the related art.

In the related art, an externally oxidized intermediate layer (hereinafter, sometimes simply referred to as "intermediate layer") mainly containing silicon oxide is formed on the surface of a base steel sheet by performing annealing (thermal oxidation treatment, or intermediate layer forming annealing) on the base steel sheet having no forsterite film in an atmosphere with controlled dew point, and an insulation coating is formed by applying an insulation coating forming solution onto the intermediate layer and performing baking annealing thereon. The cross-sectional structure of the electrical steel sheet in the related art has a three-layer structure of "insulation coating-intermediate layer-base steel sheet" as shown in FIG. 2.

The present inventors intensively studied the method of improving the coating adhesion of the insulation coating, and obtained the following findings.

During the baking annealing of the insulation coating forming solution, the interface of the base steel sheet is locally oxidized to discretely form local oxidized areas mainly containing silicon oxide with a structure different from that of the intermediate layer at the interface between the intermediate layer mainly containing silicon oxide and the base steel sheet (finding (1)).

When the local oxidized areas are excessively formed, the coating adhesion of the insulation coating is reduced (finding (2)). On the other hand, when the local oxidized areas are optimally controlled, the coating adhesion of the insulation coating is significantly improved. The phenomenon that the surface of the base steel sheet is locally oxidized during the baking annealing of the insulation coating forming solution can be controlled to some extent by controlling the conditions of thermal oxidation annealing (annealing in an atmosphere with controlled dew point) for forming the intermediate layer, and the conditions of the baking annealing for forming the insulation coating. Therefore, the coating adhesion of the insulation coating can be increased by appropriately controlling the formation state of the local oxidized area (finding (3)).

The electrical steel sheet of the present invention is made based on the above findings, and achieves the improvement in the coating adhesion of the insulation coating by a method basically different from the method of improving the coating adhesion of the insulation coating in the related art, that is, a method of more uniformly and smoothly forming an intermediate layer mainly containing silicon oxide on the surface of a base steel sheet in the related art.

Figure 3:
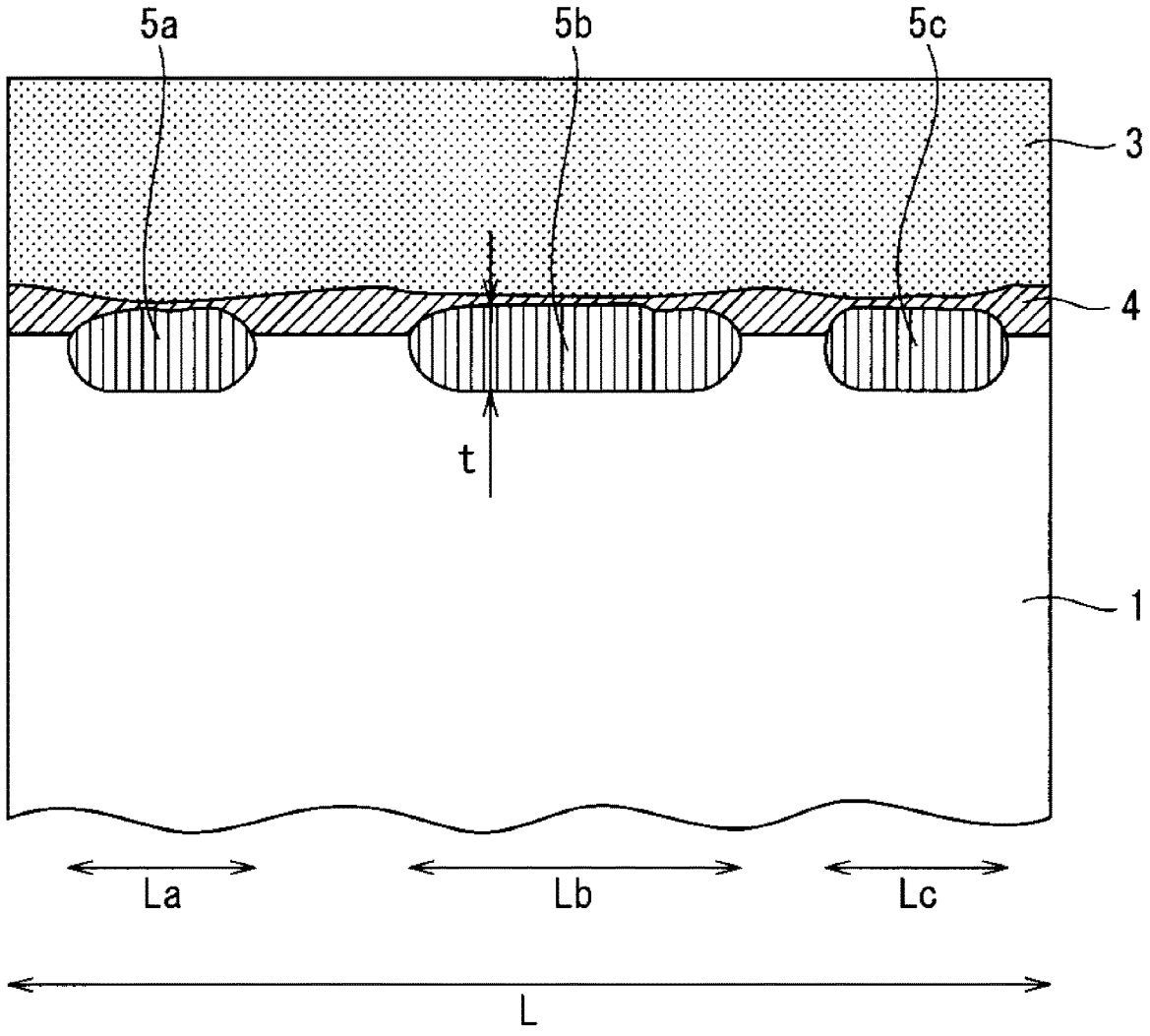
FIG. 3 is a cross-sectional schema showing a layering structure of a grain-oriented electrical steel sheet according to an embodiment of the present invention.

The layering structure of the electrical steel sheet of the present invention is schematically shown in FIG. 3. The cross-sectional structure of the electrical steel sheet according to the present invention has, unlike the three-layer structure (see FIG. 2) of "base steel sheet-intermediate layer-insulation coating" in the related art, an irregular three-layer structure of "base steel sheet 1–"intermediate layer 4+local oxidized areas 5*a*, 5*b*, and 5*c*"–insulation coating 3", as shown in FIG. 3.

That is, the electrical steel sheet of the present invention is based on the premise that the thickness of the intermediate layer is not uniform and the interface of the intermediate layer is not smooth. The local oxidized areas whose structure is different from that of the intermediate layer exist at the interface between the intermediate layer and the base steel sheet, namely the intermediate layer is the "intermediate layer 4+local oxidized areas 5*a*, 5*b*, 5*c*", and thereby, the coating adhesion of the insulation coating is improved.

Hereinafter, each layer of the electrical steel sheet of the present invention will be described.

The electrical steel sheet of the present invention includes the base steel sheet, the insulation coating arranged on the outermost surface, and the intermediate layer arranged between the base steel sheet and the insulation coating. That is, the electrical steel sheet of the present invention has the base steel sheet, the intermediate layer arranged in contact with the base steel sheet, and the insulation coating arranged in contact with the intermediate layer to be the outermost surface.

Base Steel Sheet

In the above-described irregular three-layer structure, the base steel sheet as the base material has a texture in which the crystal orientation is controlled to the Goss orientation. The surface roughness of the base steel sheet is not particularly limited, but is preferably 0.5 μm or less and more preferably 0.3 μm or less in terms of arithmetic average roughness (Ra) from the viewpoint of achieving a reduction in iron loss by applying a large tension to the base steel. The lower limit of the arithmetic average roughness (Ra) of the base steel sheet is not particularly limited. However, the effect of improving the iron loss is saturated at 0.1 μm or less, so that the lower limit thereof may be 0.1 μm.

The thickness of the base steel sheet is also not particularly limited. However, in order to further reduce the iron loss, the thickness is preferably 0.35 mm or less, and more preferably 0.30 mm or less on average. The lower limit of the thickness of the base steel sheet is not particularly limited, but may be 0.10 mm from the viewpoint of manufacturing facility capacity and costs.

The base steel sheet contains a high concentration of Si (for example, 0.80 to 4.00 mass %), so that chemical affinity with the intermediate layer mainly containing silicon oxide is developed.

Insulation Coating

In the above-mentioned irregular three-layer structure, the insulation coating is a vitreous insulation coating formed by applying and baking a coating solution mainly containing a phosphate and colloidal silica. This insulation coating can apply high surface tension to the base steel sheet.

During the baking annealing of the above-mentioned coating solution, the local oxidized areas mainly containing silicon oxide with a structure different from that of the intermediate layer are formed at the interface between the intermediate layer mainly containing silicon oxide and the base steel sheet, which will be described later.

When the thickness of the insulation coating is less than 0.1 μm, it becomes difficult to apply the required surface tension to the base steel sheet, so that the thickness of the insulation coating is preferably 0.1 μm or more on average. The thickness thereof is more preferably 0.5 μm or more.

On the other hand, when the thickness of the insulation coating exceeds 10 μm, there is concern that cracks may be generated in the insulation coating at the stage of forming the insulation coating. Therefore, the thickness of the insulation coating is preferably 10 μm or less on average. The thickness thereof is more preferably 5 μm or less.

As necessary, magnetic domain refining treatment may be applied to apply local microstrain or form local grooves by laser, plasma, mechanical methods, etching, or other methods.

Intermediate Layer Mainly Containing Silicon Oxide

In the above-described irregular three-layer structure, the intermediate layer (including the local oxidized areas) mainly containing silicon oxide is arranged between the base steel sheet and the insulation coating, and has a function of bringing the base steel sheet and the insulation coating into close contact.

This intermediate layer has the local oxidized areas when viewing a cross section (specifically, a cross section parallel to the thickness direction and perpendicular to the rolling direction) whose cutting direction is parallel to the thickness direction, the thickness of the intermediate layer in an area where the local oxidized areas are included is 50 nm or more, and the thickness of the intermediate layer in an area where the local oxidized areas are not included is less than 50 nm.

The silicon oxide mainly contained in the intermediate layer is preferably $SiO_\alpha$ ($\alpha$=1.0 to 2.0). $SiO_\alpha$ ($\alpha$=1.5 to 2.0) is more preferable because silicon oxide becomes more stable. $SiO_\alpha$ ($\alpha \approx 2.0$) can be formed by sufficiently performing oxidation annealing when silicon oxide is formed on the surface of the base steel sheet.

When the oxidation annealing is performed at a normal temperature (1150° C. or less), silicon oxide remains amorphous, so that an intermediate layer of a dense material which has high strength to withstand thermal stress and can easily relax thermal stress due to increased elasticity can be formed.

Intermediate Layer in Area Where Local Oxidized Areas are Not Included

The annealing treatment for forming the intermediate layer is preferably performed at a lower temperature and for a shorter period of time from an economical viewpoint. Therefore, the thickness of the formed intermediate layer must be minimized. In the electrical steel sheet of the present invention, the thickness of the intermediate layer in the area where the local oxidized areas are not included becomes less than 50 nm.

On the other hand, when the thickness of the intermediate layer in this area is thin, the thermal stress relaxation effect is not sufficiently exhibited, and therefore, the thickness of the intermediate layer in this area is preferably 2 nm or more on average. The thickness thereof is more preferably 5 nm or more. That is, the thickness of the intermediate layer in the area where the local oxidized areas are not included may be 2 nm or more and less than 50 nm.

In addition, since high productivity is taken into consideration, the electrical steel sheet of the present invention is preferably manufactured by minimizing the time required for the intermediate layer forming process. Therefore, the thickness of the intermediate layer in the area where the local oxidized areas are not included may be the minimum within the range in which the coating adhesion can be secured, for example, 20 nm or less on average.

Intermediate Layer in Area where Local Oxidized Areas are Included

When the coating solution mainly containing a phosphate and colloidal silica is applied onto the intermediate layer mainly containing silicon oxide and baked to form the vitreous insulation coating, the surface of the base steel sheet is oxidized by the heat treatment during the baking, and the local oxidized areas mainly containing silicon oxide are discretely formed at the interface between the intermediate layer and the base steel sheet (see FIG. 3).

When the local oxidized area is excessively formed at the interface between the intermediate layer and the base steel sheet, the coating adhesion of the insulation coating is reduced. On the other hand, when the formation of the local oxidized areas is appropriately controlled, the coating adhesion of the insulation coating can be increased (finding (3)).

The reason why the coating adhesion of the insulation coating is reduced when the local oxidized areas are excessively included is not clear, but is considered to be as follows. The local oxidized area is an area in which Si in the base steel sheet is oxidized to form $SiO_2$, and increases in volume compared to the base steel sheet. When the local oxidized areas are excessively included, excessive stress acts on the insulation coating due to the volume expansion, and the insulation coating easily delaminates.

It is considered that in the formation of the local oxidized areas, water vapor components in the atmosphere or in the insulation coating diffuse in the insulation coating to reach the intermediate layer in an insulation coating baking process, and further diffuses in the intermediate layer to reach the surface of the base steel sheet, whereby Si in the base steel sheet is oxidized.

Since the diffusion of the water vapor components is rate-limited in the intermediate layer mainly containing dense silicon oxide, the amount of the water vapor components reaching the base steel sheet increases as the thickness of the intermediate layer decreases. Therefore, the local oxidized areas are likely to be formed in portions where the intermediate layer is thin and the coating adhesion is inferior. It is presumed that when the local oxidized areas are formed in the portions where the coating adhesion in the intermediate layer is inferior, the coating adhesion of the insulation coating at these portions is improved.

Therefore, in the electrical steel sheet of the present invention, properly controlling the formation of the local oxidized areas is important for securing excellent coating adhesion without unevenness. When the formation of the local oxidized areas is appropriately controlled, the thickness of the intermediate layer in the area where the local oxidized areas are included becomes 50 nm or more.

On the other hand, the upper limit of the thickness of the intermediate layer in this area is not particularly limited, and may be, for example, 812 nm on average. In addition, in order to control the thickness of the intermediate layer in this area to be uniform and to suppress defects such as voids and cracks in the layer, the thickness of this area is preferably 400 nm or less on average. The thickness thereof is more preferably 300 nm or less. That is, the thickness of the intermediate layer in the area where the local oxidized areas are included may be 50 nm or more and 812 nm or less, and may be 50 nm or more and 400 nm or less.

In addition, the present inventors examined a preferable formation state of the local oxidized areas. As a result, a line fraction X (%) defined by (Formula 1) was introduced as an index defining the preferable structure of the local oxidized areas.

$$X=(Lx\div Lz)\times 100 \quad \text{(Formula 1)}$$

Lx (μm): Sum of the lengths of the local oxidized areas in the direction orthogonal to the thickness direction Lz (μm): Total length of the observed area of the local oxidized areas in the direction orthogonal to the thickness direction The line fraction X of the local oxidized areas (hereinafter, sometimes simply referred to as "line fraction X") will be described based on the layering structure shown in FIG. 3.

In FIG. 3, the intermediate layer 4 includes the local oxidized areas 5*a*, 5*b*, and 5*c*. The local oxidized area 5*a* has a length La in the direction orthogonal to the thickness direction, the local oxidized area 5*b* has a length Lb in the direction orthogonal to the thickness direction, and the local oxidized area 5*b* has a length Lc in the direction orthogonal to the thickness direction. The local oxidized areas 5*a*, 5*b*, and 5*c* are included discretely of one another. The total length (the length in the horizontal direction in FIG. 3) of the observed visual field in the direction orthogonal to the thickness direction is L.

In the case of FIG. 3, the line fraction X of the local oxidized areas is $\{(La+Lb+Lc)\div L\}\times 100$.

The present inventors controlled the formation state of the local oxidized areas by variously changing the formation conditions of the intermediate layer and the formation conditions of the insulation coating. Then, the relationship between the line fraction X of the local oxidized areas and the fraction of remained insulation coating after a bending test (hereinafter, sometimes simply referred to as "fraction of remained coating") was investigated, and a preferable range of the line fraction X was confirmed.

If the line fraction X of the local oxidized areas is 21% or less, a fraction of remained coating of 83% or more can be achieved.

The line fraction X is preferably 0.1% or more in order to preferably obtain the effect of enhancing the coating adhesion by reinforcing the portions where the coating adhesion is inferior and reducing the unevenness of the coating adhesion. According to the test results by the present inventors, a fraction of remained coating of 85% or more can be achieved at a line fraction X of 0.1% or more. A more preferable line fraction X is 0.3% or more.

On the other hand, when the line fraction X is too large, there are cases where stress exerted on the insulation coating by the local oxidized areas becomes large, the insulation coating easily delaminates, and the fraction of remained insulation coating decreases. Therefore, the line fraction X is preferably 12% or less. According to the test results by the present inventors, a fraction of remained coating of 85% or more can be achieved at a line fraction X of 12% or less. A more preferable line fraction X is 7% or less.

That is, in the electrical steel sheet of the present invention, when viewing the cross section whose cutting direction is parallel to the thickness direction, and when the total length of the observed visual field in the direction orthogonal to the thickness direction is referred as Lz in units of μm, the total length of the local oxidized areas in the direction orthogonal to the thickness direction is referred as Lx in units of μm, and the line fraction X of the local oxidized areas is defined by the above Formula 1, the line fraction X is preferably 0.1% or more and 12% or less.

As for the layer thickness of the local oxidized areas, when it is considered that the local oxidized areas are formed at portions where the intermediate layer is thin and the coating adhesion is inferior and have a function of reinforcing and uniformizing the coating adhesion of the insulation coating at these portions, the thickness of the local oxidized areas (see tin FIG. 3) preferably exceeds the thickness of the intermediate layer in order to reliably obtain the effect of uniformizing the coating adhesion by the reinforcement.

For example, regarding the local oxidized area 5*b* having a thickness t in FIG. 3, in a case where the thickness of the intermediate layer in this area (the thickness of the intermediate layer excluding the local oxidized area 5*b*) is 2 to 20 nm on average, the thickness of the local oxidized areas 5*b* is preferably 80 to 400 nm on average. When the thickness of the local oxidized area is 80 nm or more, the effect of uniformizing the coating adhesion by the reinforcement is preferably obtained. On the other hand, when the thickness of the local oxidized area is 400 nm or less, the insulation coating does not easily delaminate, which is preferable.

As described above, the feature of the electrical steel sheet of the present invention is that the local oxidized areas formed by oxidizing the surface of the base steel sheet by the heat treatment during the baking of the insulation coating forming solution are included at the interface between the intermediate layer and the base steel sheet.

The composition (chemical composition) of the base steel sheet is not particularly limited. However, since the grain-oriented electrical steel sheet is manufactured through various processes, preferable compositions of a base steel piece (slab) and the base steel sheet for manufacturing the electrical steel sheet of the present invention will be described below. Hereinafter, % related to the compositions of the base steel piece and the base steel sheet means mass %.

Composition of Base Steel Sheet

The base steel sheet of the electrical steel sheet of the present invention contains, for example, Si: 0.8% to 7.0%, C: 0.005% or less, N: 0.005% or less, the total amount of S and Se: 0.005% or less, acid-soluble Al: 0.005% or less, and a remainder consisting of Fe and impurities.

Si: 0.80% or More and 7.0% or Less

Si (silicon) increases the electric resistance of the grain-oriented electrical steel sheet and reduces the iron loss. A preferable lower limit of the Si content is 0.8%, and more preferably 2.0%. On the other hand, when the Si content exceeds 7.0%, the saturation magnetic flux density of the base steel sheet decreases, which makes it difficult to reduce the size of the core. A preferable upper limit of the Si content is 7.0%.

C: 0.005% or Less

C (carbon) forms a compound in the base steel sheet and degrades the iron loss, so that the amount thereof is preferably small. The C content is preferably limited to 0.005% or less. The upper limit of the C content is preferably 0.004%, and more preferably 0.003%. Since the amount of C is preferably small, the lower limit thereof includes 0%. However, when C is reduced to less than 0.0001% in amount, the manufacturing costs significantly increase. Therefore, a practical lower limit thereof is 0.0001% in terms of manufacturing.

N: 0.005% or Less

N (nitrogen) forms a compound in the base steel sheet and degrades the iron loss, so that the amount thereof is preferably small. The N content is preferably limited to 0.005% or less. The upper limit of the N content is preferably 0.004%, and more preferably 0.003%. Since the amount of N is preferably small, the lower limit thereof may be 0%.

Total Amount of S and Se: 0.005% or Less

S (sulfur) and Se (selenium) form a compound in the base steel sheet and degrade the iron loss, so that the amount thereof is preferably small. It is preferable to limit the amount of one of S and Se or the sum of the two to 0.005% or less. The total amount of S and Se is preferably 0.004% or less, and more preferably 0.003% or less. Since the S or Se content is preferably small, the lower limit of each thereof may be 0%.

Acid-Soluble Al: 0.005% or Less

Acid-soluble Al (acid-soluble aluminum) forms a compound in a base steel sheet and degrades the iron loss, so that the amount thereof is preferably small. The amount of the acid-soluble Al is preferably 0.005% or less. The amount of the acid-soluble Al is more preferably 0.004% or less, and even more preferably 0.003% or less. Since the amount of the acid-soluble Al is preferably small, the lower limit thereof may be 0%.

The remainder of the composition of the above-described base steel sheet consists of Fe and impurities. The term "impurities" refers to those incorporated from ore or scrap as a raw material, manufacturing environments, and the like when steel is industrially manufactured.

Furthermore, the base steel sheet of the electrical steel sheet of the present invention may contain, instead of a portion of Fe as the remainder, as optional elements, for example, at least one selected from Mn (manganese), Bi (bismuth), B (boron), Ti (titanium), Nb (niobium), V (vanadium), Sn (tin), Sb (antimony), Cr (chromium), Cu (copper), P (phosphorus), Ni (nickel), and Mo (molybdenum) within the range that does not inhibit the characteristics.

The amounts of the optional elements described above may be, for example, as follows. The lower limit of the optional elements is not particularly limited, and the lower limit may be 0%. Moreover, even if these optional elements are contained as impurities, the effect of the electrical steel sheet of the present invention is not impaired.

Mn: 0% or more and 0.15% or less,
Bi: 0% or more and 0.010% or less,
B: 0% or more and 0.080% or less,
Ti: 0% or more and 0.015% or less,
Nb: 0% or more and 0.20% or less,
V: 0% or more and 0.15% or less,
Sn: 0% or more and 0.30% or less,
Sb: 0% or more and 0.30% or less,
Cr: 0% or more and 0.30% or less,
Cu: 0% or more and 0.40% or less,
P: 0% or more and 0.50% or less,
Ni: 0% or more and 1.00% or less, and
Mo: 0% or more and 0.10% or less.

Composition of Base Steel Piece (Slab)

C (carbon) is an element effective in controlling a primary recrystallization texture. The amount of C is preferably 0.005% or more. The amount of C is more preferably 0.02% or more, 0.04% or more, and even more preferably 0.05% or more. When the amount of C exceeds 0.085%, decarburization does not proceed sufficiently in a decarburization process, and the required magnetic characteristics cannot be obtained, so that the amount of C is preferably 0.085% or less. The amount thereof is more preferably 0.065% or less.

When the amount of Si (silicon) is less than 0.80%, austenitic transformation occurs during final annealing, and alignment of grains in the Goss orientation is inhibited, so that the amount of Si is preferably 0.80% or more. On the other hand, when the amount of Si exceeds 4.00%, the base steel sheet is hardened, the workability is deteriorated, and it is difficult to perform cold rolling, so that it is necessary to cope with facilities for warm rolling and the like. From the viewpoint of workability, the amount of Si is preferably 4.00% or less. The amount thereof is more preferably 3.80% or less.

When the amount of Mn (manganese) is less than 0.03%, toughness decreases, and cracking easily occurs during hot rolling. Therefore, the amount of Mn is preferably 0.03% or more. The amount thereof is more preferably 0.06% or more. On the other hand, when the amount of Mn exceeds 0.15%, a large amount of MnS and/or MnSe are formed nonuniformly, and secondary recrystallization does not stably proceed, so that the amount of Mn is preferably 0.15% or less. The amount thereof is more preferably 0.13% or less.

When the amount of the acid-soluble Al (acid-soluble aluminum) is less than 0.010%, the precipitation amount of AlN that functions as an inhibitor is insufficient, and secondary recrystallization does not stably and sufficiently proceed, so that the amount of the acid-soluble Al is preferably 0.010% or more. The amount thereof is more preferably 0.015% or more. On the other hand, when the amount of the acid-soluble Al exceeds 0.065%, AlN is coarsened and the function thereof as an inhibitor decreases. Therefore, the amount of the acid-soluble Al is preferably 0.065% or less. The amount thereof is more preferably 0.060% or less.

When the amount of N (nitrogen) is less than 0.004%, the precipitation amount of AlN functioning as an inhibitor is insufficient, and secondary recrystallization does not stably and sufficiently proceed, so that the amount of N is preferably 0.004% or more. The amount thereof is more preferably 0.006% or more. On the other hand, when the amount of N exceeds 0.015%, a large amount of nitrides are precipitated nonuniformly during hot rolling, which disturbs the progress of recrystallization. Therefore, the amount of N is preferably 0.015% or less. The amount thereof is more preferably 0.013% or less.

When the amount of one of S (sulfur) and Se (selenium) or the sum of the two is less than 0.005%, the precipitation amount of MnS and/or MnSe functioning as an inhibitor is insufficient, and secondary recrystallization does not stably and sufficiently proceed, so that the amount of one of S and Se or the sum of the two is preferably 0.005% or more. The amount thereof is more preferably 0.007% or more. On the other hand, when the total amount of S and Se exceeds 0.050%, purification is insufficient during final annealing and iron loss characteristics decrease. Therefore, the amount of one of S and Se or the sum of the two is preferably 0.050% or less. The amount thereof is more preferably 0.045% or less.

The remainder of the chemical composition of the above-described base steel piece consists of Fe and impurities. The term "impurities" refers to those incorporated from ore or scrap as a raw material, manufacturing environments, and the like when steel is industrially manufactured.

Furthermore, the base steel piece of the electrical steel sheet of the present invention may contain, instead of a portion of Fe as the remainder, as optional elements, for example, one or two or more of P, Cu, Ni, Sn, and Sb within the range that does not inhibit the characteristics. The lower limit of the optional elements is not particularly limited, and the lower limit may be 0%.

P (phosphorus) is an element that increases the electrical resistivity of the base steel sheet and contributes to a reduction of the iron loss. However, when the amount thereof exceeds 0.50%, the hardness increases excessively and the rolling characteristics deteriorate. Therefore, the amount thereof is preferably 0.50% or less. The amount thereof is more preferably 0.35% or less.

Cu (copper) is an element that forms fine CuS or CuSe that functions as an inhibitor and contributes to the improvement in the magnetic characteristics. However, when the amount thereof exceeds 0.40%, the effect of improving the magnetic characteristics is saturated and surface defects are incurred during hot rolling. Therefore, the amount thereof is preferably 0.40% or less. The amount thereof is more preferably 0.35% or less.

Ni (nickel) is an element that increases the electrical resistivity of the base steel sheet and contributes to a reduction of the iron loss. However, when the amount thereof exceeds 1.00%, secondary recrystallization becomes unstable. Therefore, the amount of Ni is preferably 1.00% or less. The amount thereof is more preferably 0.75% or less.

Sn (tin) and Sb (antimony) are elements that segregate at grain boundaries and have a function of controlling the oxidation behavior during decarburization annealing. However, when the amount thereof exceeds 0.30%, decarburization does not easily proceed during the decarburization annealing, so that the amounts of both Sn and Sb are preferably 0.30% or less. The amount of each element is more preferably 0.25% or less.

Furthermore, the base steel piece of the electrical steel sheet of the present invention may adjunctively contain, instead of a portion of Fe as the remainder, as optional elements, for example, one or two or more of Cr, Mo, V, Bi, Nb, and Ti as an element forming an inhibitor. The lower limit of these elements is not particularly limited, and the lower limit may be 0%. The upper limits of these elements may be Cr: 0.30%, Mo: 0.10%, V: 0.15%, Bi: 0.010%, Nb: 0.20%, and Ti: 0.015%, respectively.

Next, a method of manufacturing the electrical steel sheet of the present invention will be described.

In a method of manufacturing a grain-oriented electrical steel sheet according to the present embodiment (hereinafter, sometimes referred to as the "manufacturing method of the present invention"), (a) a base steel sheet in which a film of an inorganic mineral material such as forsterite formed during final annealing is removed by pickling, grinding, or the like is annealed, or (b) a base steel sheet in which the formation of the film of the above-mentioned inorganic mineral material is suppressed during final annealing is annealed, (c) an intermediate layer mainly containing silicon oxide is formed on the surface of the base steel sheet by the above annealing (thermal oxidation annealing, annealing in an atmosphere with controlled dew point), (d) an insulation coating forming solution mainly containing a phosphate and colloidal silica is applied onto the intermediate layer and baked, and (e) local oxidized areas mainly containing silicon oxide with a structure different from that of the intermediate layer are discretely formed at the interface between the intermediate layer and the steel sheet by oxidizing the surface of the base steel sheet by a heat treatment during the baking.

According to the manufacturing method of the present invention, the local oxidized areas can be appropriately formed at portions where the intermediate layer is thin and the coating adhesion is inferior.

The base steel sheet in which a film of an inorganic mineral material such as forsterite is removed by pickling, grinding, or the like, and the base steel sheet in which the formation of the film of the above-mentioned inorganic mineral material is suppressed, are manufactured, for example, as follows.

A silicon steel piece containing 0.80 to 4.00 mass % of Si, preferably a silicon steel piece containing 2.0 to 4.0 mass % of Si is hot-rolled, is subjected to annealing as necessary after the hot rolling, is thereafter subjected to cold-rolling once or cold-rolling two times or more times with intermediate annealing therebetween, and is finished to a steel sheet having a final thickness. Next, the steel sheet having the final thickness is subjected to the decarburization annealing, and thereby, the primary recrystallization is proceeded in addition to decarburization, and an oxide layer is formed on the surface of the steel sheet.

Next, an annealing separator containing magnesia as a main component is applied onto the surface of the steel sheet having the oxide layer. After drying the annealing separator, the steel sheet is wound into a coil, and subjected to final annealing (secondary recrystallization). During the final annealing, a forsterite film mainly containing forsterite ($Mg_2SiO_4$) is formed on the surface of the steel sheet. The forsterite film is removed by pickling, grinding, or the like. After the removal, preferably, the surface of the steel sheet is finished smooth by chemical polishing or electrolytic polishing.

On the other hand, as the above-mentioned annealing separator, an annealing separator containing alumina as a main component can be used instead of magnesia. An annealing separator containing alumina as a main component is applied onto the surface of the steel sheet having the oxide layer, and dried. After drying the annealing separator, the steel sheet is wound into a coil, and subjected to final annealing (secondary recrystallization). In a case where the annealing separator containing alumina as a main component is used, the formation of a film of an inorganic mineral material such as forsterite on the surface of the steel sheet is suppressed even when final annealing is performed. After the final annealing, preferably, the steel sheet surface is finished smooth by chemical polishing or electrolytic polishing.

By annealing the base steel sheet in which the film of the inorganic mineral material such as forsterite is removed or the base steel sheet in which the formation of the film of the inorganic mineral material such as forsterite is suppressed, an intermediate layer mainly containing silicon oxide is formed on the surface of the base steel sheet.

The thickness of the intermediate layer is controlled by appropriately controlling one or two or more of the conditions of the annealing temperature, holding time, and annealing atmosphere. In order to increase the productivity of a grain-oriented electrical steel sheet, the intermediate layer forming process is preferably performed at a low annealing temperature in a possible range for a short annealing time. Therefore, the thickness of the intermediate layer must be minimized within a range in which the coating adhesion can be secured. Therefore, the thickness of the intermediate layer after the intermediate layer for ruing process is less than 50 nm.

The annealing for forming the intermediate layer is preferably performed at an annealing temperature of 600° C. to 1150° C. from the viewpoint of forming externally oxidized silicon oxide on the surface of the steel sheet. The atmosphere during the heating stage and soaking stage in the annealing is preferably a reducing atmosphere so as not to cause the inside of the steel sheet to be oxidized, and is particularly preferably a nitrogen atmosphere in which hydrogen is mixed. For example, an atmosphere containing hydrogen:nitrogen at 75%:25% with a dew point of −20° C. to 2° C. is preferable.

In the annealing (thermal oxidation annealing) for forming the intermediate layer, the dew point and the oxidation degree of the atmosphere during the cooling stage are maintained lower than the dew point and the oxidation degree (=water vapor partial pressure/hydrogen partial pressure) of the atmosphere during the soaking stage. By changing the dew point and the oxidation degree from the soaking stage to the cooling stage, portions where the thickness of the intermediate layer is locally thin are made further thinner.

The portions where the thickness of the intermediate layer is locally thin are portions where the coating adhesion is inferior. However, by further reducing the thickness of these portions, local oxidized areas are preferentially formed in these portions during the baking annealing of the insulation coating. As a result, the coating adhesion of the insulation coating at these portions can be improved.

In the manufacturing method of the present invention, during the annealing for forming the intermediate layer, the dew point and the oxidation degree are changed from the soaking stage to the cooling stage, and the dew point and the oxidation degree of the atmosphere during the cooling stage are maintained lower than those during the soaking stage. For example, after the soaking stage, cooling is performed in an atmosphere containing hydrogen:nitrogen at 75%:25% with a dew point −50° C. to −20° C. An atmosphere containing hydrogen:nitrogen at 75%:25% with a dew point of −20° C. or lower corresponds to oxidation degree≤0.0014. Such an atmosphere having a low oxidation degree during cooling after the formation of the intermediate layer is one of the features of the manufacturing method of the present invention.

An insulation coating forming solution mainly containing a phosphate and colloidal silica is applied onto the intermediate layer mainly containing silicon oxide and baked to form an insulation coating. The baking of the above-mentioned coating solution is performed, for example, in a nitrogen-hydrogen mixed atmosphere containing hydrogen: nitrogen at 75%:25% with a dew point of 5° C. to 50° C. by a heat treatment at 650° C. to 950° C.

By the heat treatment during the baking, the surface of the steel sheet in an area where the thickness of the intermediate layer is locally thin is locally oxidized, so that local oxidized areas are discretely formed at the interface between the intermediate layer and the steel sheet.

During the baking annealing of the coating solution, the dew point and the oxidation degree of the atmosphere during the cooling are maintained lower than the dew point and the oxidation degree of the atmosphere during the baking. By changing the dew point and the oxidation degree from the baking stage to the cooling stage, the change in the structure of the local oxidized area is suppressed. For example, in an atmosphere containing hydrogen:nitrogen at 75%:25% with a dew point of 5° C. to 10° C., cooling is performed while maintaining the oxidation degree of the atmosphere during the cooling lower than that during the baking.

In the manufacturing method of the present invention, it is preferable to maintain the dew point and the oxidation degree of the atmosphere during cooling to 500° C. lower than that during baking. For example, after baking, by changing the dew point and the oxidation degree, cooling to 500° C. is preferably controlled to an atmosphere containing hydrogen:nitrogen at 75%:25% with a dew point of 5° C. to 10° C. (0.0116≤oxidation degree≤0.0163). Such an atmosphere having a low oxidation degree during cooling after the formation of the insulation coating is one of the features of the manufacturing method of the present invention.

The formation state of the local oxidized area is changed by controlling the annealing conditions such as temperature and atmosphere. For example, increasing the oxidation degree leads to internal oxidation, and decreasing the oxidation degree leads to external oxidation. In the manufacturing method of the present invention, internal oxidation or external oxidation may be adopted as long as the fine local oxidized areas are preferably formed in a small amount.

Internal oxidation is suitable for efficiently forming the local oxidized areas, and external oxidation is suitable for improving the coating adhesion. In order to achieve both the efficient formation of the local oxidized areas and the improvement in the coating adhesion, a form of a transition region between the internal oxidation and the external oxidation is preferable, and a form of external oxidation close to internal oxidation is more preferable.

In addition, when the local oxidized areas are formed, there are cases where a portion of the base steel sheet is cut off depending on the state of oxidation reaction proceeded, and steel is incorporated into the local oxidized areas. In addition, there are cases where inclusions and precipitates are included in the local oxidized areas. In the present embodiment, the local oxidized areas may include steel, inclusions, precipitates, and the like.

Each layer of the electrical steel sheet of the present invention sheet is observed and measured as follows.

A test piece is cut out from the grain-oriented electrical steel sheet in which the insulation coating is formed, and the layering structure of the test piece is observed with a scanning electron microscope (SEM) and a transmission electron microscope (TEM).

Specifically, first, a test piece is cut out so that the cutting direction is parallel to the thickness direction (specifically, the test piece is cut out so that the cross section is parallel to the thickness direction and perpendicular to the rolling direction), and the cross-sectional structure of this cross section is observed with an SEM at a magnification at which each layer is included in the observed visual field. For example, in observation with a reflection electron composition image (COMP image), it can be inferred how many layers the cross-sectional structure includes. For example, in the COMP image, the steel sheet can be distinguished as light color, the intermediate layer (including the local oxidized areas) as dark color, and the insulation coating as intermediate color.

In order to identify each layer in the cross-sectional structure, line analysis is performed along the thickness direction using SEM-EDS (energy dispersive X-ray spectroscopy), and quantitative analysis of the chemical composition of each layer is performed. The elements to be quantitatively analyzed are five elements Fe, P, Si, O, and Mg.

From the observation results in the COMP image and the quantitative analysis results by SEM-EDS, in a case where an area has an Fe content of 80 at % or more excluding measurement noise, and the line segment (thickness) on the scanning line of the line analysis corresponding to this area is 300 nm or more, the area is determined as the base steel sheet, and an area excluding the base steel sheet is determined as the intermediate layer (including the local oxidized areas) and the insulation coating.

Regarding the area excluding the base steel sheet identified above, from the observation results in the COMP image and the quantitative analysis results by SEM-EDS, in a case where an area has an Fe content of less than 80 at %, a P content of 5 at % or more, a Si content of less than 20 at %, an O content of 50 at % or more, and a Mg content of 10 at % or less excluding the measurement noise, and the line segment (thickness) on the scanning line of the line analysis corresponding to this area is 300 nm or more, the area is determined as the insulation coating.

In addition, in order to determine the area which is the insulation coating, precipitates, inclusions, and the like which are contained in the insulation coating are not considered as determination objects, but the area that satisfies the quantitative analysis results as a matrix is determined as the insulation coating. For example, when the presence of precipitates, inclusions, and the like on the scanning line of the line analysis is confirmed from the COMP image or the line analysis results, this area is not considered for the determination of the insulation coating, and the insulation coating is determined by the quantitative analysis results as the matrix. The precipitates and inclusions can be distinguished from the matrix by contrast in the COMP image, and can be distinguished from the matrix by the amounts of constituent elements included in the quantitative analysis results.

In a case where an area excludes the base steel sheet and the insulation coating identified above and the line segment (thickness) on the scanning line of the line analysis corresponding to this area is 300 nm or more, this area is determined as an area including the intermediate layer (including the local oxidized areas).

The identification of each layer and the measurement of the thickness by the above-mentioned COMP image observation and SEM-EDS quantitative analysis are performed on five places or more while changing the observed visual field. Regarding the thicknesses of the insulation coating obtained from five places or more in total, an average value is calculated by excluding the maximum value and the minimum value from the values, and this average value is taken as the average thickness of the insulation coating.

In addition, if an insulation coating in which the line segment (thickness) on the scanning line of the line analysis is less than 300 nm is included in at least one of the observed visual fields of five places or more as described above, the insulation coating is observed in detail by TEM, and the identification of the insulation coating and the measurement of the thickness are performed by TEM.

In addition, the area including the intermediate layer (including the local oxidized areas) is observed by TEM in detail because the spatial resolution of SEM is low, and the identification of the intermediate layer (including the local oxidized areas) and the measurement of the thickness are performed by TEM.

A test piece containing an intermediate layer (including the local oxidized areas) and a test piece containing the insulation coating as necessary are cut out by focused ion beam (FIB) processing so that the cutting direction is parallel to the thickness direction (specifically, a test piece is cut out so that the cross section is parallel to the thickness direction and perpendicular to the rolling direction), and the cross-sectional structure of this cross section is observed (bright-field image) with a scanning-TEM (STEM) at a magnification at which the corresponding layer is included in the observed visual field. In a case where each layer is not included in the observed visual field, the cross-sectional structure is observed in a plurality of continuous visual fields.

In order to identify each layer of the intermediate layer (including the local oxidized areas) and the insulation coating as necessary in the cross-sectional structure, line analysis is performed along the thickness direction using TEM-EDS, and quantitative analysis of the chemical composition of each layer is performed. The elements to be quantitatively analyzed are five elements Fe, P, Si, O, and Mg.

From the observation results of the bright-field image by TEM and the quantitative analysis results by TEM-EDS described above, each layer is identified and the thickness of each layer is measured.

In a continuous area of 50 nm or more on the scanning line of the line analysis, an area having an Fe content of 80 at % or more excluding the measurement noise is determined as the base steel sheet, and an area excluding this base steel sheet is determined as the intermediate layer and the insulation coating.

Regarding the area excluding the base steel sheet identified above, from the observation results of the bright-field image and the quantitative analysis results by TEM-EDS, an area having an Fe content of less than 80 at %, a P content of 5 at % or more, a Si content of less than 20 at %, an O content of 50 at % or more, and a Mg content of 10 at % or less excluding the measurement noise in the continuous area of 50 nm or more on the scanning line of line analysis is determined as the insulation coating. In addition, in order to determine the area which is the insulation coating, precipitates, inclusions, and the like which are contained in the insulation coating are not considered as determination objects, but the area that satisfies the quantitative analysis results as a matrix is determined as the insulation coating.

An area excluding the base steel sheet and the insulation coating identified above is determined as the intermediate layer (including the local oxidized areas). This intermediate layer (including the local oxidized areas) may satisfy an Fe content of less than 80 at % on average, a P content of less than 5 at % on average, and a Si content of 20 at % or more on average, a O content of 50 at % or more on average, and a Mg content of 10 at % or less on average as the average of the entire intermediate layer. In addition, the quantitative analysis results of the above-mentioned intermediate layer do not include analysis results of steel, precipitates, inclusions, and the like contained in the intermediate layer but are quantitative analysis results as a matrix.

The line segment (thickness) on the scanning line of the line analysis is measured for each layer identified above. When the thickness of each layer is 5 nm or less, it is preferable to use a TEM having a spherical aberration correction function from the viewpoint of spatial resolution. When the thickness of each layer is 5 nm or less, point analysis is performed, for example, at intervals of 2 nm along the thickness direction, the line segment (thickness) of each layer is measured, and this line segment may be adopted as the thickness of each layer. For example, when TEM having a spherical aberration correction function is used, EDS analysis can be performed with a spatial resolution of about 0.2 nm.

The observation and measurement with the above-mentioned TEM are performed on five places or more while changing the observed visual field. Regarding the measurement results obtained from five places or more in total, an average value is calculated by excluding the maximum value and the minimum value from the values, and this average value is adopted as the average thickness of the corresponding layer. In a case of confirming variation in the thickness of each layer as necessary, a standard deviation may be calculated from the above measurement results and used in "(average value)±(standard deviation)".

Whether or not the intermediate layer of the electrical steel sheet of the present invention has local oxidized areas, the thickness of the intermediate layer in the area where the local oxidized areas are included, the thickness of the intermediate layer in the area where the local oxidized areas are not included, and the like are identified by the following method.

The observation with a TEM bright-field image in which each layer is identified by the above-mentioned TEM-EDS analysis is performed on an area having a total length of 300 μm or more in the direction orthogonal to the thickness direction. When only intermediate layer having a thickness of less than 50 nm in the thickness direction is included in this area, it is determined that local oxidized areas are not included, and when an intermediate layer having a thickness of 50 nm or more in the thickness direction is included, it is determined that local oxidized areas are included. That is, the thickness of the intermediate layer in the area where the local oxidized areas are included is 50 nm or more, and the thickness of the intermediate layer in the area where local oxidized areas are not included is less than 50 nm.

Furthermore, by image analysis, the area having a thickness of 50 nm or more in the thickness direction (intermediate layer in the area where the local oxidized areas are included) is identified, and the length of the area in the direction orthogonal to the thickness direction is obtained. When the distance between the local oxidized areas adjacent to each other (the distance in the direction orthogonal to the thickness direction) is less than 0.5 μm, it is regarded as one continuous local oxidized area.

Based on the above image analysis result, the line fraction X defined in (Formula 1) is determined from the total length of the observed visual field and the length of the sum of the local oxidized areas. Regarding image binarization for image analysis, image binarization may be performed by manually coloring the intermediate layer (including the local oxidized areas) in the photograph based on the above-described identification result of the local oxidized areas.

In the electrical steel sheet of the present invention, the intermediate layer is included in contact with the base steel sheet, and the insulation coating is included in contact with the intermediate layer. Therefore, in a case of identifying each layer according to the above-described criterion, layers other than the base steel sheet, the intermediate layer (including the local oxidized areas), and the insulation coating are not included.

In addition, the amounts of Fe, P, Si, O, Mg, and the like contained in the base steel sheet, the intermediate layer (including the local oxidized areas), and the insulation coating described above are a criterion for identifying the base steel sheet, the intermediate layer, and the insulation coating and obtaining the thicknesses thereof.

Furthermore, Ra (arithmetic average roughness) of the surface of the base steel sheet may be measured using a stylus type surface roughness measuring device.

The fraction of remained insulation coating is evaluated by conducting a bending adhesion test. A 80 mm×80 mm test piece having a flat plate shape is rolled around a round bar with a diameter of 20 mm and is stretched flat, the area of the insulation coating that does not delaminate from this test piece is measured, a value obtained by dividing the area that does not delaminate by the area of the steel sheet is defined as the fraction of remained coating (area %), and the coating adhesion of the insulation coating is evaluated. For example, calculation may be performed by placing a transparent film with a 1-mm grid scale on the test piece and measuring the area of the insulation coating that does not delaminate.

EXAMPLES

Hereinafter, the effects of an aspect of the present invention will be described in detail with reference to the following examples. However, the condition in the examples is an example condition adopted to confirm the operability and the effects of the present invention, so that the present invention is not limited to the example condition. The present invention can adopt various types of conditions as long as the conditions do not depart from the scope of the present invention and can achieve the object of the present invention.

Example 1

A base steel piece having the composition shown in Table 1 was heat-treated at 1150° C. for 60 minutes and then subjected to hot rolling to obtain a hot-rolled steel sheet having a thickness of 2.6 mm. Next, the hot-rolled steel sheet was subjected to hot-band annealing in which the hot-rolled steel sheet was held at 1120° C. for 200 seconds, immediately cooled, held at 900° C. for 120 seconds, and then rapid cooled. The hot-band annealed sheet was pickled and then subjected to cold rolling to obtain a cold-rolled steel sheet having a final thickness of 0.27 mm.

TABLE 1

| BASE | COMPOSITION (mass %) | | | | | |
|---|---|---|---|---|---|---|
| STEEL PIECE | Si | C | Al | Mn | S | N |
| A | 3.21 | 0.055 | 0.029 | 0.080 | 0.008 | 0.008 |

The cold-rolled steel sheet (hereinafter referred to as "steel sheet") was subjected to decarburization annealing at 850° C. for 180 seconds in an atmosphere containing hydrogen:nitrogen at 75%:25%. The steel sheet after the decarburization annealing was subjected to nitriding annealing at 750° C. for 30 seconds in a mixed atmosphere of hydrogen-nitrogen-ammonia to control the nitrogen content of the steel sheet to 230 ppm.

An annealing separator containing alumina as a main component was applied to the steel sheet after the nitriding annealing. Subsequently, the steel sheet was subjected to final annealing by being heated to 1200° C. at a heating rate of 15° C./hr in a mixed atmosphere of hydrogen and nitrogen, and then was subjected to purification annealing by being held at 1200° C. for 20 hours in a hydrogen atmosphere. Then, the steel sheet was naturally cooled, whereby a base steel sheet having a smooth surface was obtained.

The base steel sheet after final annealing was heated to a holding temperature at a heating rate of 10° C./s in an atmosphere of 25% $N_2$+75% $H_2$, and then was held for 30 seconds, and subsequently, the dew point of the atmosphere was immediately changed as appropriate, and the steel sheet was naturally cooled, whereby an intermediate layer mainly containing silicon oxide was formed.

An insulation coating solution mainly containing a phosphate and colloidal silica was applied to the steel sheet in which the intermediate layer was formed. The steel sheet was heated to a holding temperature in an atmosphere including hydrogen:nitrogen at 75%:25%, and was held for 30 seconds, and subsequently, the dew point of the atmosphere was immediately changed as appropriate so as not to cause the structure of the local oxidized areas to change, and the steel sheet was cooled in furnace to 500° C. and then was naturally cooled, whereby an insulation coating was formed.

The surface of the base steel sheet was locally oxidized by the above-mentioned thermal oxidation annealing (intermediate layer forming annealing, annealing in an atmosphere with controlled dew point) for forming the intermediate layer, and the above-mentioned baking annealing for forming the insulation coating, whereby local oxidized areas are formed at the interface between the intermediate layer and the steel sheet.

Based on the observation and measurement methods described above, a test piece was cut out from the grain-oriented electrical steel sheet in which the insulation coating was formed, the cross-sectional structure of the test piece was observed with a scanning electron microscope (SEM) and a transmission electron microscope (TEM), and the thickness of the intermediate layer in the area where the local oxidized areas are included, the thickness of the intermediate layer in the area where local oxidized areas are not included, and the line fraction X were obtained. The results are shown in Table 2.

TABLE 2

| | INTERMEDIATE LAYER FORMING ANNEALING | | | INSULATION COATING BAKING ANNEALING | | |
|---|---|---|---|---|---|---|
| TEST PIECE | HOLDING TEMPERATURE (° C.) | DEW POINT OF HOLDING ATMOSPHERE (° C.) | DEW POINT OF COOLING ATMOSPHERE (° C.) | HOLDING TEMPERATURE (° C.) | DEW POINT OF HOLDING ATMOSPHERE (° C.) | DEW POINT OF COOLING ATMOSPHERE (° C.) |
| A1 | 1100 | 2 | 2 | 820 | 50 | 50 |
| A2 | 800 | −15 | −15 | 860 | 3 | 3 |
| A3 | 820 | −10 | −25 | 840 | 40 | 10 |
| A4 | 880 | −15 | −35 | 860 | 30 | 10 |
| A5 | 960 | −5 | −45 | 820 | 30 | 5 |
| A6 | 700 | −20 | −25 | 940 | 60 | 55 |
| A7 | 740 | −10 | −15 | 780 | 45 | 40 |
| A8 | 840 | −5 | −10 | 840 | 35 | 30 |
| A9 | 860 | −10 | −20 | 800 | 25 | 20 |
| A10 | 760 | −10 | −10 | 790 | 40 | 35 |
| A11 | 780 | −15 | −25 | 800 | 10 | 10 |

| TEST | AVERAGE THICKNESS OF INTERMEDIATE LAYER IN AREA WHERE LOCAL OXIDIZED AREAS ARE NOT INCLUDED | AVERAGE THICKNESS OF INTERMEDIATE LAYER IN AREA WHERE LOCAL OXIDIZED AREAS ARE INCLUDED | LINE FRACTION X OF LOCAL OXIDIZED AREAS | FRACTION OF REMAINED COATING |
|---|---|---|---|---|

TABLE 2-continued

| PIECE | (nm) | (nm) | (%) | (%) | REMARKS |
|---|---|---|---|---|---|
| A1 | 37 ± 5 | NONE | 0 | 82 | COMPARATIVE EXAMPLE |
| A2 | 4 ± 1 | NONE | 0 | 75 | COMPARATIVE EXAMPLE |
| A3 | 5 ± 2 | 375 | 7 | 93 | INVENTION EXAMPLE |
| A4 | 8 ± 3 | 218 | 5 | 92 | INVENTION EXAMPLE |
| A5 | 12 ± 5 | 102 | 0.3 | 95 | INVENTION EXAMPLE |
| A6 | 2 ± 1 | 812 (COMMENT 1) | 21 | 83 | INVENTION EXAMPLE |
| A7 | 3 ± 1 | 633 | 15 | 84 | INVENTION EXAMPLE |
| A8 | 6 ± 1 | 296 | 9 | 89 | INVENTION EXAMPLE |
| A9 | 7 ± 2 | 167 | 0.1 | 86 | INVENTION EXAMPLE |
| A10 | 3 ± 1 | NONE | 0 | 76 | COMPARATIVE EXAMPLE |
| A11 | 4 ± 1 | NONE | 0 | 78 | COMPARATIVE EXAMPLE |

(COMMENT 1) INTERNAL OXIDATION WAS SLIGHTLY FOUND.

In the invention examples having the local oxidized areas, the coating adhesion of the insulation coating is excellent. Particularly, in Invention Examples A3 to A5, a fraction of remained coating of 90% or more is achieved, and it can be seen that the coating adhesion property is significantly excellent. In Invention Examples A3 to A5, it is presumed that since the dew point of the cooling atmosphere of the intermediate layer forming annealing was as low as less than −20° C., variation in the thickness of the intermediate layer was relatively large, and the local oxidized areas were likely to form at portions where the intermediate layer was locally thin during the insulation coating baking annealing.

Furthermore, it is inferred that the dew point of the cooling atmosphere during the insulation coating baking annealing was as low as 5° C. to 10° C. and local oxidized areas did not grow more than necessary. It is considered that since the local oxidized areas thus formed had an appropriate thickness of 80 to 400 nm and were appropriately included at a line fraction X of 0.3% or more and 7% or less, and the local oxidized areas were formed in the portions of the intermediate layer where the thickness was locally thin (the portions where the coating adhesion was inferior), the coating adhesion of the insulation coating was improved.

In Invention Examples A7 to A9, it is presumed that since the dew point of the cooling atmosphere of the intermediate layer forming annealing was as high as −20° C. or higher, variation in the thickness of the intermediate layer was small, and the local oxidized areas were formed in a wide range during the insulation coating baking annealing. In Invention Examples A6 to A9, although the dew point of the cooling atmosphere during the insulation coating baking annealing was lower than the dew point of the holding atmosphere, the dew point of the cooling atmosphere was relatively as high as −20° C. or higher, and thus the local oxidized areas were grown in a wider range. For this reason, it is considered that although the improvement in the coating adhesion of the insulation coating was observed, the degree of improvement was small. In Invention Examples A8 and A9, the line fraction X of the local oxidized area was in an appropriate range of 0.1% to 12%, and the improvement in the coating adhesion of the insulation coating was relatively good.

In particular, in Invention Examples A6 and A7, it is considered that although the improvement in the coating adhesion of the insulation coating was observed, since the thickness of the local oxidized areas exceeded 400 nm and the line fraction X of the local oxidized areas exceeded 12%, stress acting on the insulation coating increased and the insulation coating was somewhat likely to delaminate.

In Invention Example A6, it is considered that since portions where the thickness of the intermediate layer was locally less than 2 nm were included, thermal stress acting between the base steel sheet and the insulation coating was not sufficiently relaxed, and thus the insulation coating was likely to delaminate.

On the other hand, in Comparative Example A1, it is inferred that local oxidized areas were not formed during the insulation coating baking annealing.

In Comparative Example A2, it is inferred that since the atmosphere during cooling for the intermediate layer forming annealing was the same as the atmosphere during holding, the layer thickness of the formed intermediate layer was uniform, locally thin portions were rarely included, and thus local oxidized areas were not formed during the insulation coating baking annealing.

In Comparative Examples A10 and A11, it is inferred that since the dew point during cooling was not lower than the dew point during soaking in either the intermediate layer forming annealing or the insulation coating baking annealing, local oxidized areas were not preferably formed.

INDUSTRIAL APPLICABILITY

According to the aspect of the present invention, it is possible to provide a grain-oriented electrical steel sheet with an insulation coating having no unevenness in coating adhesion, that is, a grain-oriented electrical steel sheet excellent in the coating adhesion of insulation coating even without a forsterite film. Therefore, industrial applicability is high.

BRIEF DESCRIPTION OF THE REFERENCE SYMBOLS

1 base steel sheet
2 forsterite film

3 insulation coating
4 intermediate layer
5*a*, 5*b*, 5*c* local oxidized area
La, Lb, Lc length of local oxidized area
t thickness of local oxidized area

What is claimed is:

1. A grain-oriented electrical steel sheet comprising:
a base steel sheet;
an intermediate layer arranged in contact with the base steel sheet; and
an insulation coating arranged in contact with the intermediate layer to be an outermost surface,
wherein the intermediate layer has areas where a local oxidized area is included and areas where the local oxidized area is not included when viewing a cross section whose cutting direction is parallel to a thickness direction, and
a thickness of the intermediate layer in the areas where the local oxidized area is included is 50 nm or more, and a thickness of the intermediate layer in the areas where the local oxidized area is not included is less than 50 nm.

2. The grain-oriented electrical steel sheet according to claim 1,
wherein, in said cross-section, a total length of an observed visual field in a direction orthogonal to the thickness direction is referred as Lz in units of μm, a total length of the local oxidized area in the direction orthogonal to the thickness direction is referred as Lx in units of μm, and a line fraction X of the local oxidized area is defined by a following Formula 1, and
wherein the line fraction X is 0.1% or more and 12% or less, $$X=(Lx\div Lz)\times 100 \quad \text{(Formula 1).}$$

3. The grain-oriented electrical steel sheet according to claim 1,
wherein the thickness of the intermediate layer in the areas where the local oxidized area is included is 50 nm or more and 400 nm or less, and the thickness of the intermediate layer in the areas where the local oxidized area is not included is 2 nm or more and less than 50 nm.

4. The grain-oriented electrical steel sheet according to claim 2,
wherein the thickness of the intermediate layer in the areas where the local oxidized area is included is 50 nm or more and 400 nm or less, and the thickness of the intermediate layer in the areas where the local oxidized area is not included is 2 nm or more and less than 50 nm.

5. The grain-oriented electrical steel sheet according to claim 1,
wherein the local oxidized area exists at the interface between the intermediate layer and the base steel sheet.

* * * * *